US005876193A

United States Patent [19]

Hosono et al.

[11] Patent Number: 5,876,193

[45] Date of Patent: Mar. 2, 1999

[54] OIL PUMP ROTOR HAVING A GENERATED CYCLOID CURVE

[75] Inventors: Katsuaki Hosono; Manabu Katagiri, both of Niigata, Japan

[73] Assignee: Mitsubishi Materials Corporation, Tokyo, Japan

[21] Appl. No.: 783,802

[22] Filed: Jan. 15, 1997

[30] Foreign Application Priority Data

Jan. 17, 1996 [JP] Japan ..... 8-006173

[51] Int. Cl.[6] ..... F04C 2/10

[52] U.S. Cl. ..... 418/150; 418/171

[58] Field of Search ..... 418/150, 160, 418/171

[56] References Cited

U.S. PATENT DOCUMENTS 1,284,650 11/1918 Gollings ..... 418/171
5,368,455 11/1994 Eisenmann ..... 418/150

FOREIGN PATENT DOCUMENTS 25 52 454 A1 6/1976 Germany .
39 38 346 C1 4/1991 Germany .
42 00 883 C1 4/1993 Germany .
61-4882 1/1986 Japan ..... 418/171

*Primary Examiner*—John J. Vrablik
*Attorney, Agent, or Firm*—Armstrong, Westerman, Hattori, McLeland & Naughton

[57] ABSTRACT

The present invention relates to an oil pump rotor provided with an inner rotor 10 to which n (n is a natural number) outer teeth 11 are formed, an outer rotor 20 to which n+1 inner teeth 21 are formed which engage with each of the outer teeth 11, and a casing 30 in which an intake port 31 for taking up fluid and an expulsion port 32 for expelling fluid are formed, wherein:

the outer teeth of inner rotor are formed by alternately combining an epicycloid curve and a hypocycloid curve, the epicycloid curve being generated as an orbit of the point on a circle which rolls along the outside of the base circle without slipping, and the hypocycloid curve being generated as an orbit of a point on a circle which rolls along the inside of the base circle without slipping; the alternately combined curve being generated under the following condition, where E is the diameter of the circle which rolls along the outside of the base circle, and H is the diameter of the circle which rolls along the inside of the base circle:

$$0.5 \leqq H/E \leqq 0.8.$$

7 Claims, 5 Drawing Sheets

OIL PUMP ROTOR HAVING A GENERATED CYCLOID CURVE

BACKGROUND OF THE INVENTION

The present invention relates to an oil pump rotor used in an oil pump which intakes and expels a fluid according to changes in the capacity of a plurality of cells which are formed between inner and outer rotors.

Conventional oil pump rotors are provided with an inner rotor on which n (n being a natural number) outer teeth are formed, an outer rotor on which n+1 inner teeth are formed for engaging with the outer teeth, and a casing in which an intake port for taking in fluid and an expulsion port for expelling fluid are formed. In this oil pump, the inner rotor is rotated, causing the outer teeth to engage the inner teeth and thereby rotate the outer rotor. Fluid is then taken in or expelled due to changes in the capacity of the plurality of cells which are formed between the rotors.

Individual cells are partitioned due to contact between the respective outer teeth of the inner rotor and the inner teeth of the outer rotor at the front and rear of the direction of rotation, and by the presence of the casing of the oil pump which exactly covers either side of the inner and outer rotors. Thus, independent fluid carrier chambers are formed as a result. Once the capacity of a cell has fallen to a minimum value during the process of engagement between the outer teeth of the inner rotor and inner teeth of the outer rotor, the cell next proceeds along an intake port where its capacity is expanded, causing fluid to be taken in. After the cell's capacity reaches a maximum value, the cell next proceeds along an expulsion port where its capacity is decreased, causing the fluid to be expelled.

In this type of oil pump rotor, a sliding contact is always present between the casing and each edge surface of the inner and outer rotors, and between the outer periphery of the outer rotor and the casing. Further, a sliding contact is also always present between the outer teeth of the inner rotor and the inner teeth of the outer rotor at the front and rear of each cell. While this is extremely important for maintaining the liquid-tight character of the cells which are carrying the fluid, when the resistance generated by each of the sliding parts becomes large, then this sliding contact may cause a significant increase in mechanical loss in the oil pump. Accordingly, reducing the resistance generated by the various sliding parts in an oil pump has been a problem in this field.

SUMMARY OF THE INVENTION

Accordingly, the present invention was conceived in consideration of the above described circumstances, and has as its objective a reduction in mechanical loss in an oil pump by reducing the resistance which is generated by each of the sliding components in the inner and outer rotors and the casing, while at the same time ensuring the oil pump rotor's durability and reliability.

In order to achieve the aforementioned objective, the outer teeth of the inner rotor in the oil pump of the present invention are formed by alternately combining an epicycloid curve and a hypocycloid curve, wherein the epicycloid curve is generated as an orbit of a point on a circle which rolls along the outside of a base circle without slipping, and the hypocycloid curve is generated as an orbit of a point on a circle which rolls along the inside of the base circle without slipping.

The alternately combined curve is generated under the following condition, where E is the diameter (mm) of a circle which rolls along the outside of a base circle, and H is the diameter (mm) of a circle which rolls along the inside of the base circle:

$$0.5 \leqq H/E \leqq 0.8$$

In addition, run-offs which are not in contact with the inner teeth of the outer rotor are provided to the front side or to both the front and rear sides of the direction of rotation of the outer teeth of the inner rotor.

As a result of the above described design, the resistance generated by each of the sliding parts in the inner rotor, outer rotor and casing is reduced, thereby reducing mechanical loss in this oil pump.

$$0.5 \leqq H_i/E_i \leqq 0.8$$

Figure 1:
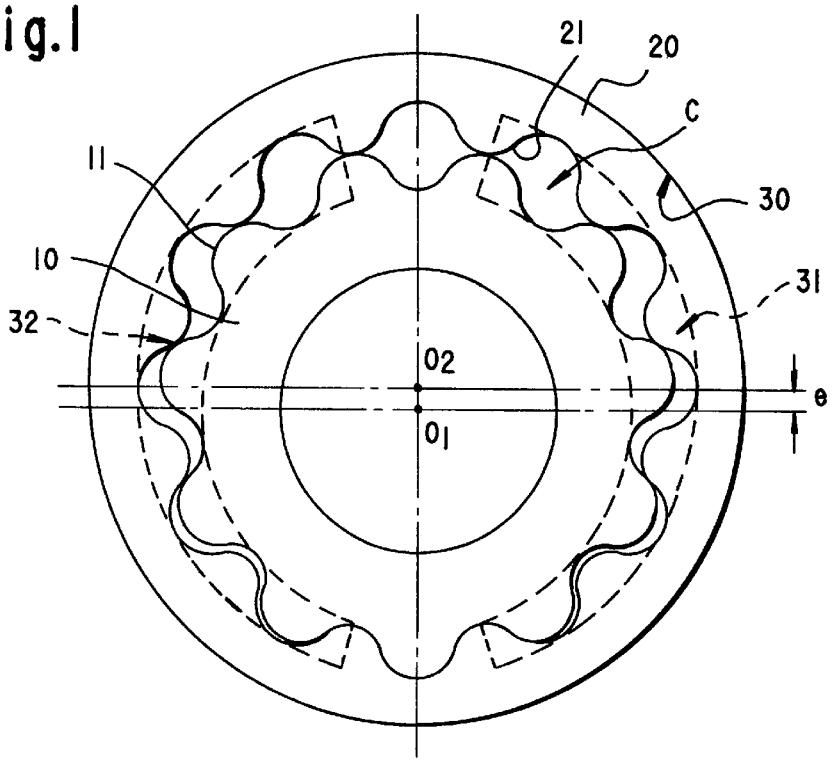
FIG. 1 is a planar view of a first embodiment of the oil pump rotor according to the present invention, wherein the outer teeth of the inner rotor are formed along a combined cycloid curve generated within limits which satisfy the following expression.
Figure 2:
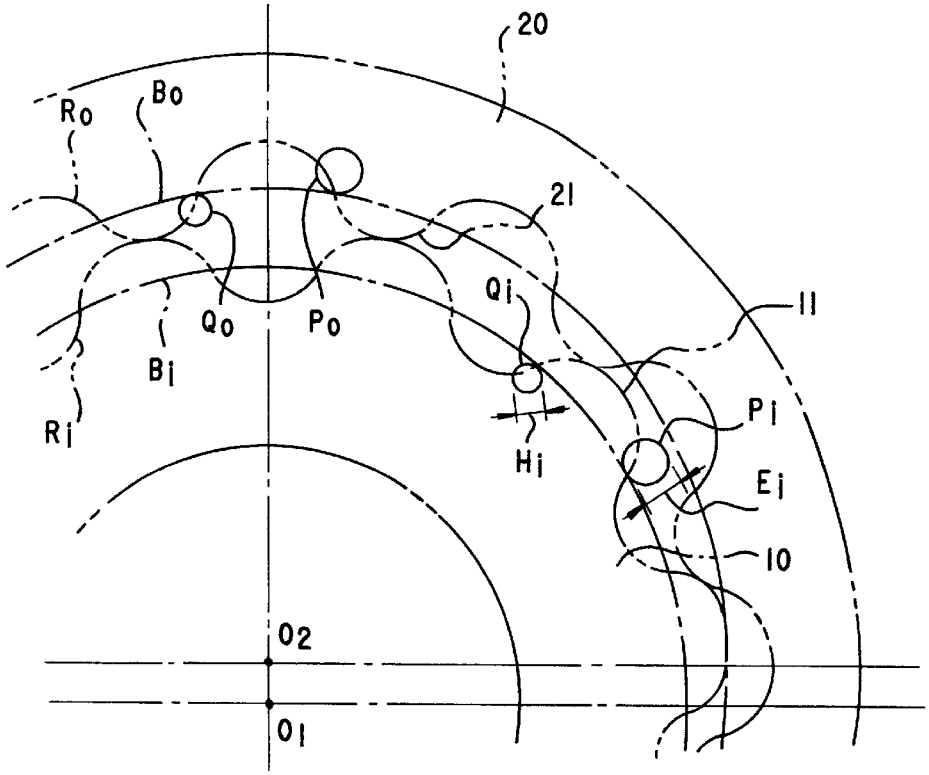

FIG. 2 is a planar view showing the method of generating the inner rotor shown in FIG. 1.

Figure 3:
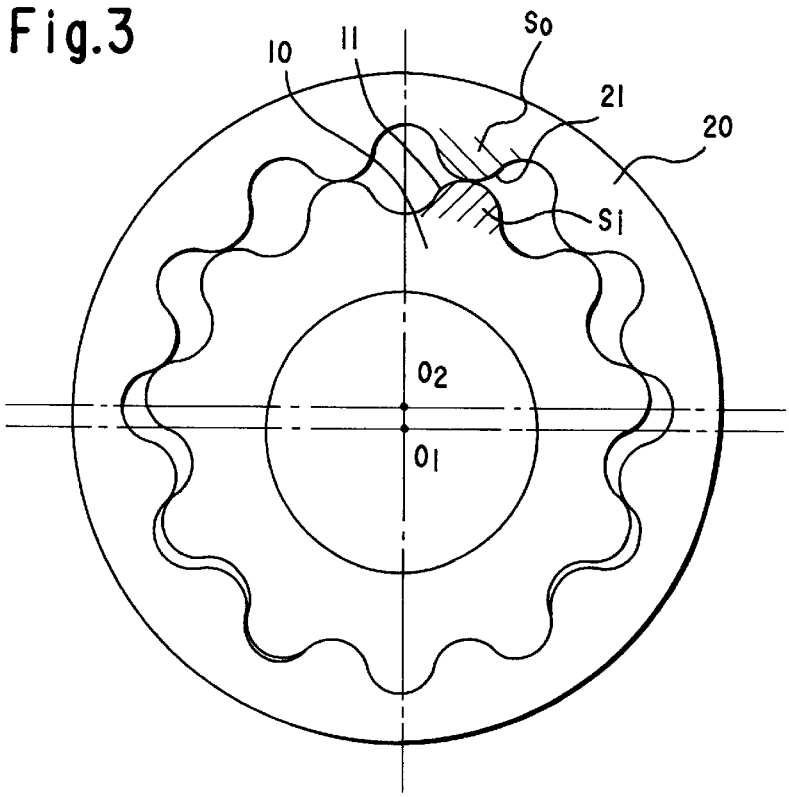

FIG. 3 is a planar view of an oil pump rotor offered as an example for comparison with the oil pump rotor shown in FIG. 1, wherein the outer teeth of the inner rotor are formed along a combined cycloid curve originated within the limits which satisfy the following expression:

$$H_i/E_i > 0.8$$

Figure 4:
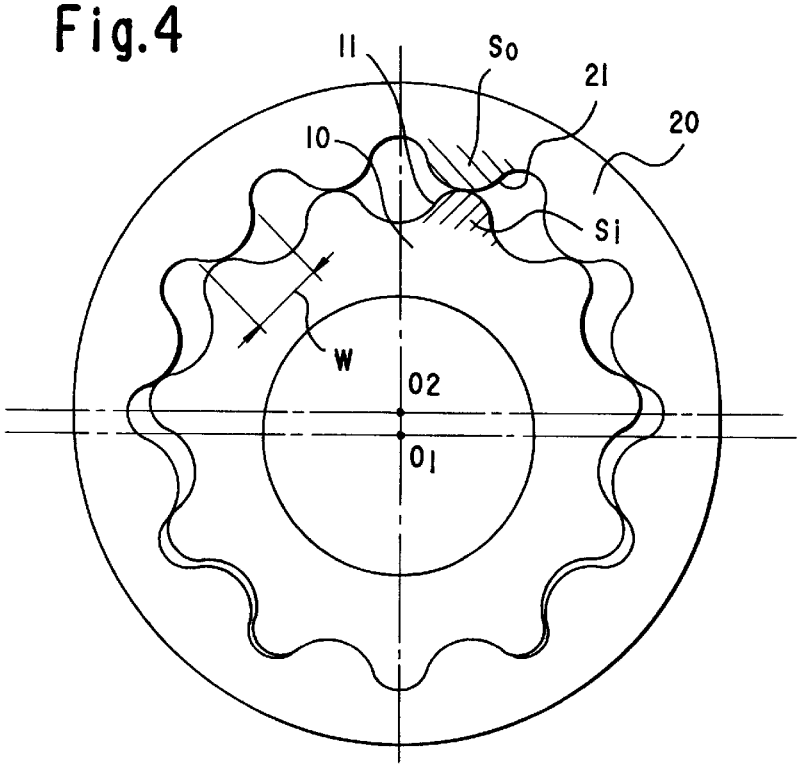

FIG. 4 is a planar view of an oil pump rotor offered as an example for comparison with the oil pump rotor shown in FIG. 1, wherein the outer teeth of the inner rotor are formed along a combined cycloid curve originated within the limits which satisfy the following expression:

$$H_i/E_i > 0.8$$

Figure 5:
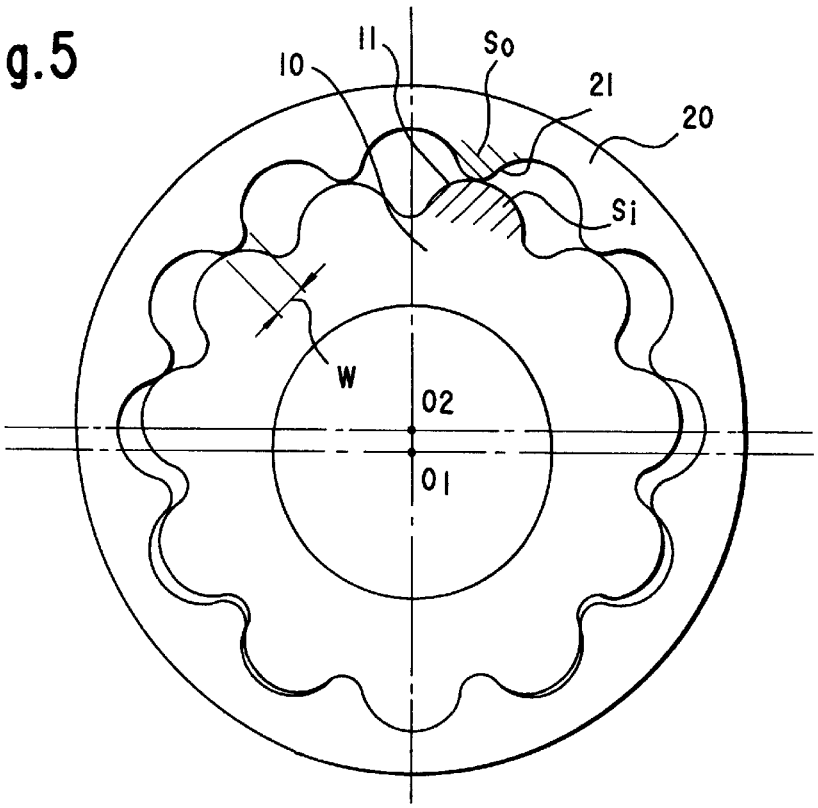

FIG. 5 is a planar view of an oil pump rotor offered as an example for comparison with the oil pump rotor shown in FIG. 1, wherein the outer teeth of the inner rotor are formed along the combined cycloid curve originated within the limits which satisfy the following expression:

$$H_i/E_i < 0.5.$$

Figure 6:
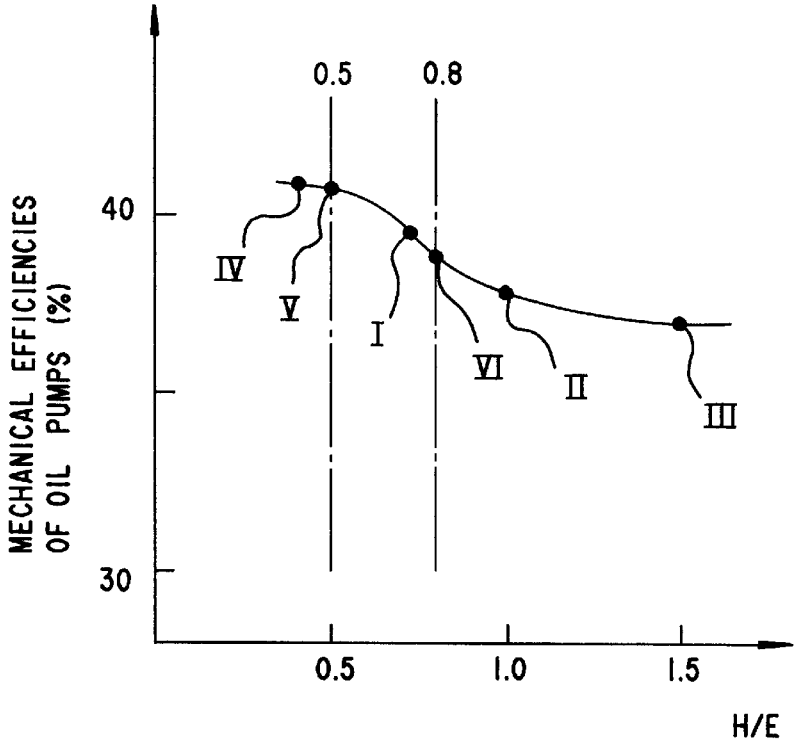

FIG. 6 is a graph showing the mechanical efficiency of an oil pump provided with an inner rotor in which outer teeth are formed by employing an arbitrarily selected value for $H_i/E_i$.

Figure 7:
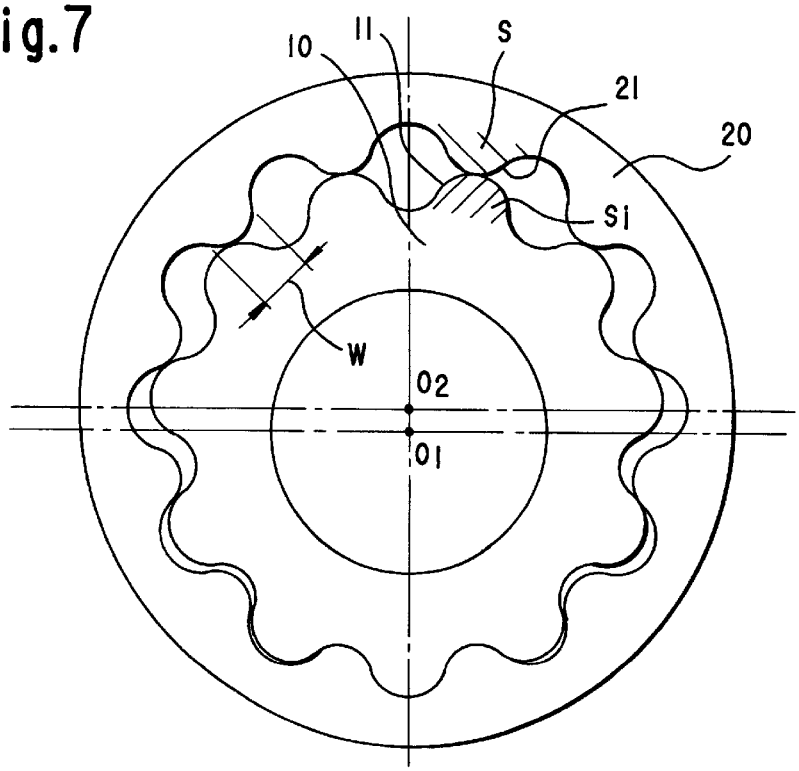

FIG. 7 is a planar view of an oil pump rotor, wherein the outer teeth of the inner rotor are formed along the combined cycloid curve originated within the limits which satisfy the following expression:

$$H_i/E_i = 0.8$$

Figure 8:
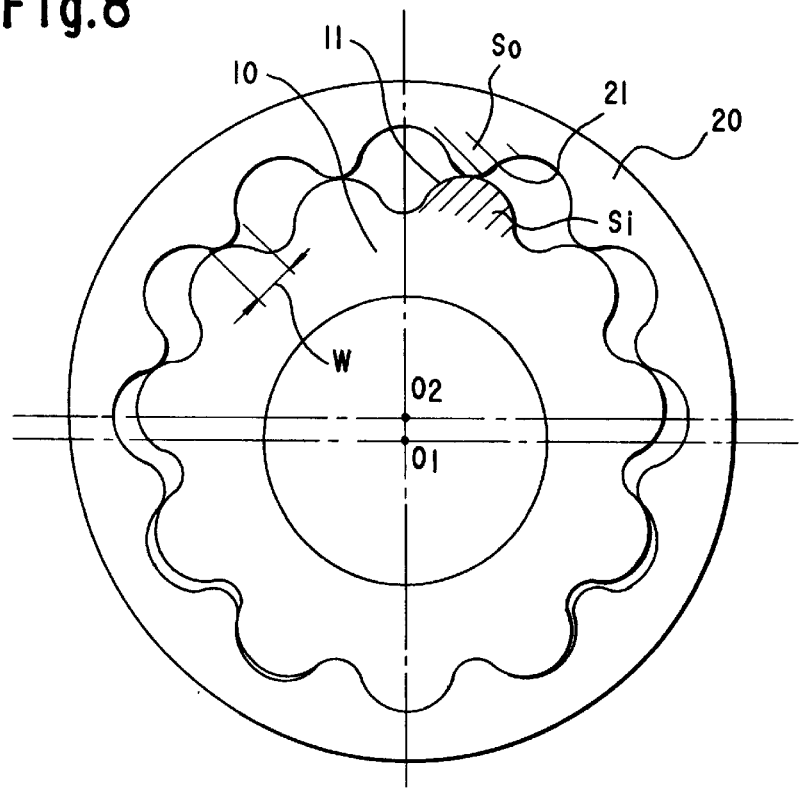

FIG. 8 is a planar view of an oil pump rotor, wherein the outer teeth of the inner rotor are formed along the combined cycloid curve originated within the limits which satisfy the following expression:

$$H_i/E_i = 0.5$$

Figure 9:
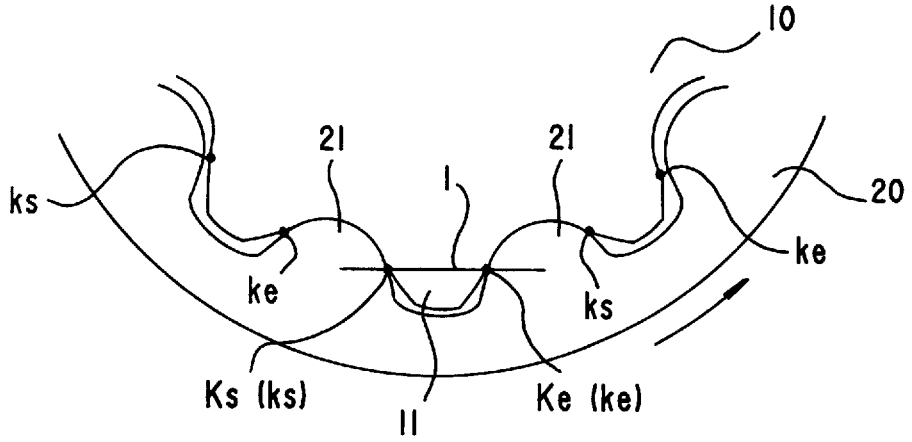

FIG. 9 is a planar view of a principal component in the second embodiment of the oil pump rotor according to the present invention, showing the state of engagement between the outer teeth of the inner rotor and the inner teeth of the outer rotor.

Figure 10:
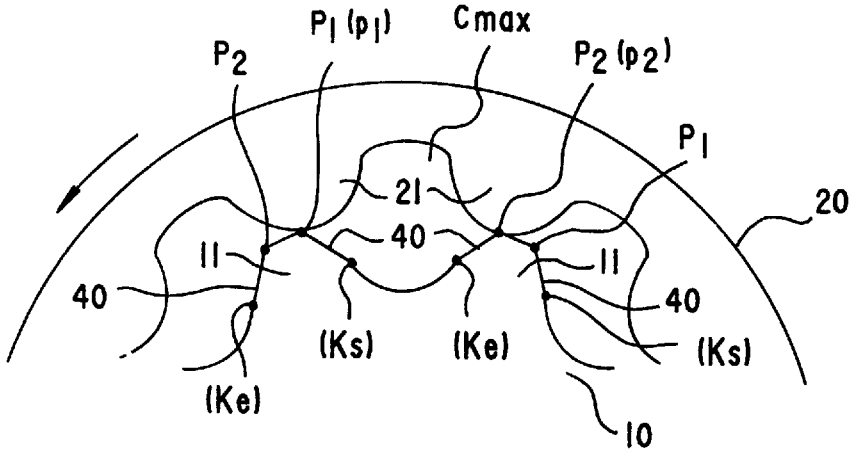

FIG. 10 is planar view of a principal component in the second embodiment of the present invention, showing the state of contact between the outer teeth of the inner rotor and the inner teeth of the outer rotor when cell capacity is at a maximum value.

DESCRIPTION OF THE PREFERRED EMBODIMENTS

The first embodiment of the oil pump rotor of the present invention will now be explained.

The oil pump rotor shown in FIG. 1 is provided with an inner rotor 10 on which n outer teeth are formed (wherein n is a natural number; n=10 in the present embodiment), an outer rotor 20 on which n+1 inner teeth are formed which engage with each of the outer teeth, and a casing 30 which houses inner rotor 10 and outer rotor 20 therein.

Inner rotor 10 is attached to a rotational axis, and is supported in a rotatable manner about axis center $O_1$. Outer teeth 11 of inner rotor 10 are formed by alternately combining an epicycloid curve and a hypocycloid curve, wherein the epicycloid curve is generated as an orbit of a point on a circle $P_i$ which rolls along the outside of a base circle $B_i$ without slipping, and the hypocycloid curve is generated as an orbit of a point on a circle $Q_i$ which rolls along the inside of the base circle without slipping.

The alternately combined cycloid curve $R_i$ is generated under the following condition, where E is the diameter of a circle $P_i$ which rolls along the outside of a base circle $B_i$, and H is the diameter of the circle $Q_i$ which rolls along the inside of a base circle $B_i$:

$$0.5 \leqq H_i/E_i \leqq 0.8$$

(In FIGS. 1 and 2 $H_i/E_i=0.72$).

Outer rotor 20 is disposed such that its axial center $O_2$ is eccentric (amount of eccentricity: e) to the axial center $O_1$ of inner rotor 10, and is supported to enable rotation about this axis center $O_2$. Inner teeth 21 of outer rotor 20 are formed by alternately combining an epicycloid curve and a hypocycloid curve, wherein the epicycloid curve is generated as an orbit of a point on a circle $P_0$ which rolls along the outside of the base circle $B_0$ of outer rotor 20 without slipping, and the hypocycloid curve is generated as an orbit of a point on a circle $Q_0$ which rolls along the inside of base circle $B_0$ without slipping. The combined cycloid curve is designated as $R_0$.

A plurality of cells C are formed in between the tooth surfaces of inner rotor 10 and outer rotor 20 along the direction of rotation of rotors 10,20. Each cell C is individually partitioned as a result of contact between respective outer teeth 11 of inner rotor 10 and inner teeth 21 of outer rotor 20 at the front and rear of the direction of rotation of the rotors 10,20, and by the presence of a casing 30 which exactly covers either side of the inner and outer rotors 10,20. As a result, independent fluid carrier chambers are formed. Cells C rotate and move in accordance with the rotation of rotors 10,20, with the capacity of each cell C reaching a maximum and falling to a minimum level during each rotation cycle as the rotors repeatedly rotate.

An arcuate intake port 31 is formed in casing 30 along the area in which the capacity of a given cell C formed between the tooth surfaces of rotors 10,20 is increasing. Similarly, an arcuate expulsion port 32 is formed along the area in which the capacity of a given cell C formed between the tooth surfaces of rotors 10,20 is decreasing.

The present invention is designed so that, after the capacity of a given cell C has reached a minimum during the engagement between outer teeth 11 and inner teeth 12, fluid is taken into the cell as the cell's capacity expands as it moves along intake port 31. Similarly, after the capacity of a given cell C has reached a maximum during the engagement of outer teeth 11 and inner teeth 12, fluid is expelled from the cell as the cell's capacity decreases as it moves along expulsion port 32.

In an oil pump of the above described design, a frictional torque T in opposition to the sliding resistance, which is generated between the edge surfaces of rotors 10,20 and casing 30 when rotating rotors 10,20, may be calculated from the following equation:

$$T=M\cdot S\cdot l$$

where S is the sliding area, l is the distance from the center of rotation to the sliding part, and M is the frictional force per unit area operating between the rotors 10,20 and the casing 30.

From this equation it may be understood that one means Lo reduce the frictional torque T is to place the sliding parts far from the rotational center, i.e., reduce the area of sliding between the edge surfaces of outer rotor 20 and casing 30.

Based on the preceding, the oil pump rotor shown in FIGS. 3 and 4 may be considered which is provided with an inner rotor 10 in which outer teeth 11 are formed along a combined cycloid curve originated within the limits which satisfy the following expression:

$$H_i/E_i>0.8$$

In this oil pump rotor, the area of edge surface $S_0$ of inner tooth 21 becomes larger with respect to the area of edge surface $S_i$ of outer tooth 11 as the value of $H_i/E_i$ is made larger. As a result, the sliding area of outer rotor 20 becomes large, causing the frictional torque T to increase as a result. (FIG. 3 shows the case where $H_i/E_i=1.0$; FIG. 4 shows the case where $H_i/E_i=1.48$).

FIG. 5 shows an oil pump rotor provided with an inner rotor 10 in which outer teeth 11 are formed along a combined cycloid curve originated within limits satisfying the following expression:

$$H_i/E_i<0.5$$

In this oil pump, the area of edge surface $S_0$ of inner tooth 21 is small with respect to the area of edge surface $S_i$ of outer tooth 11. As a result, the sliding area of outer rotor 20 becomes small, causing the frictional torque T to decrease. However, because the width W of inner teeth 21 along the direction of rotation of outer rotor 20 narrows, inner teeth 21 break easily during engagement with outer teeth 11. Accordingly, the durability of inner teeth 21 in the oil pump rotor deteriorates. (FIG. 5 shows the case where $H_i/E_i=0.4$).

FIG. 6 shows the mechanical efficiencies of oil pumps having inner rotors 10 wherein the outer teeth 11 are formed by using arbitrarily chosen values for $H_i/E_i$.

First, it can be seen that the mechanical efficiency of the oil pump decreases as the value of $H_i/E_i$ increase within the range $H_i/E_i>0.8$.

Additionally, it can be seen that the mechanical efficiency of the oil pump increases as the value of $H_i/E_i$ decreases within the range $0.5 \leqq H_i/E_i \leqq 0.8$.

In the range of $H_i/E_i<0.5$, the mechanical efficiency of the oil pump does not increase greatly, and as the value of $H_i/E_i$ becomes smaller, the width W of the inner teeth 21 along the rotational direction of the outer rotor 20 becomes narrower, so that the inner teeth become more likely to become worn.

The oil pump rotors employed in the oil pumps corresponding to each of the points I, II, III, and IV on the graph in FIG. 6 are shown in FIGS. 1, 3, 4, and 5, respectively.

Additionally, the oil pump rotors used in the oil pumps corresponding to each of the points V and VI on the graph which are at the boundaries of the range $0.5<H_i/E_i\leqq 0.8$ are shown in FIGS. 7 and 8, respectively.

The oil pump rotor shown in FIG. 7 is provided with an inner rotor 10 in which outer teeth 11 are formed along a combined cycloid curve generated by satisfying the expression $H_i/E_i=0.8$. In this oil pump rotor, the area of edge surface $S_0$ of inner teeth 21 is designed to be slightly larger compared to the area of edge surface $S_i$ of outer teeth 11. In other words, emphasis has been placed on improving the durability of outer rotor 20. If the area of edge surface $S_0$ of inner teeth 21 exceeds the above range, however, the mechanical loss due to frictional resistance increases, so that sufficient improvement in mechanical efficiency can no longer be realized.

The oil pump rotor shown in FIG. 8 is provided with an inner rotor 10 in which outer teeth 11 are formed along a combined cycloid curve originated by satisfying the expression $H_i/E_i=0.5$. In this oil pump rotor, the area of edge surface $S_0$ of inner teeth 21 is designed to be slightly smaller compared to the area of edge surface $S_i$ of outer teeth 11. In other words, emphasis has been placed on reducing mechanical loss due to sliding resistance. However, if the area of edge surface $S_0$ of inner teeth 21 exceeds the above range, inner teeth 21 become narrower in width so that the durability of inner teeth 21 is no longer sufficient.

Based on the above, an oil pump rotor may be proposed in which outer teeth 11 of inner rotor 10 are formed along a combined cycloid curve originated within the range satisfying the following expression:

$$0.5\leqq H_i/E_i\leqq 0.8$$

and in which the shape of outer rotor 20 is determined by the shape of inner rotor 10. In this oil pump rotor, the area of edge surface $S_0$ of inner teeth 21 of outer rotor 20 is made small to an extent which does not give rise to ready breakage of the inner teeth. As a result, the entire sliding area of outer rotor 20 becomes smaller, reducing the drive torque T. Therefore, it becomes possible to reduce the mechanical loss caused by sliding resistance generated between outer rotor 20 and casing 30, while at the same time ensuring the durability of inner teeth 21. Accordingly, the durability and reliability of the oil pump is ensured, while the mechanical efficiency thereof can be improved.

A second embodiment of the oil pump rotor according to the present invention will now be explained. Structural components identical to those explained above will be assigned the same numeric symbol and an explanation thereof will be omitted.

In this oil pump rotor, the outer teeth 11 of the inner rotor 10 are formed along the combined cycloid curve generated within the range satisfying the expression below, these limits also being indicated in case of the first embodiment above:

$$0.5\leqq H_i/E_i\leqq 0.8$$

Further, a run-off 40 is formed to each of the outer teeth 11 to the front and rear of the direction of rotation. Run-offs 40 are not in contact with inner teeth 21 of outer rotor 20.

FIG. 9 shows the state of engagement between the outer teeth 11 of the inner rotor 10 and the inner teeth 21 of the outer rotor 20. When the tips of outer teeth 11 of inner rotor 10 engage in the tooth spaces of inner teeth 21 to rotate outer rotor 20, the line indicating the direction of the force with which outer teeth 11 push inner teeth 21 is referred to as the "line of action". In the figure, this line of action is indicated by the symbol l. The engagement between outer teeth 11 and inner teeth 21 is carried out along this line of action l. The points on the surface of outer teeth 11 which form the intersecting point $K_B$ at which engagement begins and the intersecting point $K_e$ at which engagement ends are ordinarily fixed, and may be designated as engagement start point $k_s$ and engagement end point $k_e$ of outer teeth 11. From the perspective of a single outer tooth 11, for example, engagement start point $k_s$ is formed to the rear of the direction of rotation, while engagement end point $k_e$ is formed to the front of the direction of rotation.

FIG. 10 shows the state of contact between outer teeth 11 of inner rotor 10 and inner teeth 21 of outer rotor 20 when the capacity of cell C reaches a maximum value. The capacity of cell C reaches a maximum value when the tooth spaces between outer teeth 11 and the tooth spaces between inner teeth 21 are exactly opposite one another. In this case, the tip of inner tooth 21 and the tip of outer tooth 11 which are positioned at the front of cell $C_{max}$ come in contact at contact point $P_1$, while the tip of outer tooth 11 which is positioned to the rear of cell $C_{max}$ comes in contact with contact point $P_2$. The points on outer tooth 11 which form contact points $P_1$,$P_2$ where the cell capacity becomes maximum are ordinarily fixed, and may be designated as front contact point $p_1$ and rear contact point $p_2$ disposed at opposite ends of a flattened, either rectilinear or curvilinear tip of outer tooth 11. From the perspective of a single outer tooth 11, for example, front contact point $p_1$ is formed to the rear of the direction of rotation, while rear contact point $p_2$ is formed to the front of the direction of rotation.

Run-off 40 is formed such that it cuts off the tooth surface between the engagement end point $k_e$ and the rear contact point $p_2$ which are positioned to the front of the direction of rotation, and the tooth surface between engagement start point $k_s$ and front contact point $p_1$ which are positioned to the rear of the direction of rotation. As a result, there is no contact between the surface of outer tooth 11 and inner tooth 21.

In an oil pump rotor of the above described design, the increase and decrease in the capacity of a cell C and the contact between outer teeth 11 of inner rotor 10 and inner teeth 12 of outer rotor 20 throughout one cycle takes place as described below.

During the engagement of outer tooth 11 and inner tooth 21, the tip of outer tooth 11 engages with the tooth space of inner tooth 21 to rotate outer rotor 20 in the same way as in a conventional oil pump rotor.

Once the engagement between outer tooth 11 and inner tooth 21 ends, the capacity of cell C begins to increase as it moves along intake port 31. Due to the provision of run-off 40 at the front of the direction of rotation in outer tooth 11 of inner rotor 10 (which was in contact with the inner tooth of the outer rotor in the conventional oil pump rotor), the contact between outer tooth 11 and inner tooth 21 at the front and rear of cell C does not occur.

When the forward portion of cell C comes into communication with intake port 31, the tip of the outer tooth 11 and the tip of the inner tooth 21 which are positioned at the front of cell C come into contact. When the rear portion of cell C comes into communication with intake port 31, the tip of the inner tooth 21 and the tip of the outer tooth 11 which are positioned to the rear of cell C come in contact. In this way, a cell $C_{max}$ having a maximum capacity is formed between intake port 31 and expulsion port 32. The contact between the tip of the outer tooth 11 and the tip of the inner tooth 21 which are positioned to the rear of cell C are maintained in this configuration until this contact point reaches expulsion port 31.

Next, the capacity of cell C begins to decrease as the cell moves along expulsion port 31. Due to the provision of run-off 40 to the rear of the direction of rotation of outer tooth 11 of inner rotor 10 (which was in contact with the inner tooth of the outer rotor in conventional oil pump rotors), contact between outer tooth 11 and inner tooth 21 does not occur.

In the process during which the capacity of cell C increases as it moves along intake port 31 and the process during which the capacity of cell C decreases as it moves along expulsion port 32, adjacent cells C enter a state of communication with one another due to the provision of run-offs 40. However, in both these processes, each of the cells are in a state of communication due to positioning along intake port 31 or expulsion port 32. Thus, a decrease in the carrier efficiency of the oil pump rotor is not caused by adjacent cells C entering a state of communication with one another as described above.

As a result, outer teeth 11 and inner teeth 21 come in contact only during the engagement process therebetween, and during the process in which the capacity of a cell C reaches a maximum and then moves from intake port 31 to expulsion port 32. Outer teeth 11 and inner teeth 21 do not come in contact during the process in which the capacity of a cell C increases as the cell moves along intake port 31 and the process in which the capacity of cell C decreases as the cell moves along expulsion port 32. Thus, the number of sites where sliding contact occurs between inner rotor 10 and outer rotor 20 is decreased so that the sliding resistance generated between the teeth surfaces is small.

Taking into consideration the preceding, an oil pump rotor may be proposed in which the outer teeth 11 of inner rotor 10 are formed along the combined cycloid curve generated within the limits satisfying the following expression:

$$0.5 \leqq H_i/E_i \leqq 0.8$$

Run-offs 40 which are not in contact with the inner teeth 21 of outer rotor 20 are provided to each outer tooth 11 at the front and rear of the direction of rotation. In this oil pump rotor, contact occurs between outer teeth 11 and inner teeth 21 only during the engagement process therebetween, and during the process in which the capacity of cell C reaches a maximum and then moves from intake port 31 to expulsion port 32. Outer teeth 11 and inner teeth 21 do not come in contact during the process in which the capacity of cell C increases as the cell moves along intake port 31 and the process in which the capacity of cell C decreases as the cell moves along expulsion port 32, thus reducing the number of sites of sliding contact between inner rotor 10 and outer rotor 20. Accordingly, in addition to the effects provided by the oil pump rotor of the first embodiment as described above, since the sliding resistance generated between teeth surfaces is reduced, it is also possible to reduce the amount of drive torque needed to drive the oil pump rotor, thereby improving its mechanical efficiency. Further, by providing run-offs 40 to the rear of the direction of rotation of outer teeth 11, mechanical loss can be reduced by preventing interference between the outer teeth 11 of the inner rotor 10 and the inner teeth 21 of the outer rotor 20 which occurs due to vibrations of the oil pump during actual use thereof.

Although the inner rotor 10 of this embodiment was designed with run-offs 40 provided to the front and rear directions of rotation of outer teeth 11, it is also acceptable to provide run-offs 40 to only the front direction of rotation of outer teeth 11.

What is claimed:

1. An oil pump rotor device provided with an inner rotor on which n (n is a natural number) outer teeth are formed, an outer rotor on which n+1 inner teeth are formed to engage with each of the outer teeth, and a casing in which an intake port for taking in fluid and an expulsion port for expelling fluid are formed, fluid being taken in and expelled in this oil pump rotor by means of changes in the capacity of a plurality of cells which are formed between the teeth surfaces of each rotor during the engagement and rotation of the rotors, wherein:

the outer teeth of the inner rotor are formed by alternately combining an epicycloid curve and a hypocycloid curve, the epicycloid curve being generated as an orbit of a point on a circle which rolls along the outside of a base circle without slipping, and the hypocycloid curve being generated as an orbit of a point on a circle which rolls along the inside of the base circle without slipping; the alternately combined cycloid curves being generated under a condition: $0.5 \leqq H/E \leqq 0.8$, wherein E is the diameter (mm) of the circle which rolls along the outside of the base circle, and H is the diameter (mm) of the circle which rolls along the inside of the base circle.

2. An oil pump rotor device according to claim 1, wherein a run-off is formed on each of the outer teeth of the inner rotor at the front direction of rotation, the run-off not having contact with the inner teeth of the outer rotor.

3. An oil pump rotor device according to claim 2, wherein the run-off is formed between an engagement point when an outer tooth of the inner rotor engages with an inner tooth of the outer rotor, and a contact point between an outer tooth of the inner rotor and an inner tooth of the outer rotor when the cell capacity is increasing.

4. An oil pump rotor device according to claim 2, wherein the run-off is formed on a portion of the area between the engagement point when an outer tooth of the inner rotor engages with an inner tooth of the outer rotor, and the contact point between an outer tooth of the inner rotor and an inner tooth of the outer rotor when the cell capacity is increasing.

5. An oil pump rotor device according to claim 2, wherein the run-off is formed on the rear direction of rotation of the outer teeth of the inner rotor.

6. An oil pump rotor device according to claim 5, wherein the run-off is formed between the engagement point when an outer tooth of the inner rotor engages with an inner tooth of the outer rotor, and the contact point between an outer tooth of the inner rotor and an inner tooth of the outer rotor when the cell capacity is increasing.

7. An oil pump rotor device according to claim 5, wherein the run-off is formed on a portion of the area between the engagement point when an outer tooth of the inner rotor engages with an inner tooth of the outer rotor, and the contact point between an outer tooth of the inner rotor and an inner tooth of the outer rotor when the cell capacity is increasing.

* * * * *